United States Patent [19]

Martin

[11] Patent Number: 4,741,186

[45] Date of Patent: May 3, 1988

[54] LOCKING MECHANISM FOR SLIDING DOORS OR WINDOWS AND METHOD OF INSTALLATION

[76] Inventor: Guillermo O. Martin, 386 W. 43rd St., Hialeah, Fla. 33011

[21] Appl. No.: 28,919

[22] Filed: Mar. 23, 1987

[51] Int. Cl.[4] ..... E05B 65/08

[52] U.S. Cl. ..... 70/100; 70/82

[58] Field of Search ..... 70/81, 82, 95, 99, 100, 70/89-90; 292/159, DIG. 46

[56] References Cited

U.S. PATENT DOCUMENTS

| | | | |
|---|---|---|---|
| 1,387,185 | 8/1921 | Rothwell | 292/159 |
| 1,654,221 | 12/1927 | Kline | 292/159 |
| 2,249,214 | 7/1941 | Kurtzon | 70/100 |
| 2,448,748 | 9/1948 | Vanderveld | 70/100 |
| 3,863,470 | 2/1975 | Imer | 70/100 |

FOREIGN PATENT DOCUMENTS

| | | | |
|---|---|---|---|
| 453750 | 6/1913 | France | 292/159 |

*Primary Examiner*—Robert L. Wolfe

*Attorney, Agent, or Firm*—Robert M. Schwartz; Edward I. Mates

[57] ABSTRACT

A special locking device is provided for locking horizontally movable doors or windows of show cases by providing simple means that simultaneously move a pair of pins strategically located along track means to move through strategically located apertures to engage the inner vertical edges of a pair of said doors or windows supported in closely spaced vertical planes without penetrating said doors or windows when said doors occupy positions closing a rear opening in said show case. A low cost installation method is also described.

16 Claims, 4 Drawing Sheets

LOCKING MECHANISM FOR SLIDING DOORS OR WINDOWS AND METHOD OF INSTALLATION

BACKGROUND OF THE INVENTION

I. Field of the Invention

This invention relates to locks for sliding doors or windows. It is primarily adapted for use with an application to sliding glass doors of showcases where articles to be sold are stored for display.

One well known and largely used type of showcase has a base, that supports fixed vertical sides, a vertical front and rear, and a horizontal top, largely composed of glass. The rear of the showcase is closed by movable doors located in closely adjacent vertical planes, one in front of the other. The doors move in opposite directions with their outer edges receivable in opposite outer ends of the showcase and overlap at adjacent inner edges when the doors occupy their closed positions. Each door, also usually of glass, is also movable with respect to the other to selectively open the showcase substantially one-half of its length at either end. The doors are mounted on suitable track means for movement there along to open substantially one-half of the rear wall of the showcase at either end when the two glass doors are located in substantial alignment with each other.

II. Technology Problems and Patents of Interest

The prior art has provided sliding doors of the type just described with locks that either required the doors or windows to be notched to receive locking pins or, to avoid notching the doors or windows, special angularly shaped corner engaging devices have been used to engage certain inner corners of the windows when the windows occupy their locked positions. For one reason or another, the prior art locks needed improvement. They either required weakening of the doors or windows by providing notches or recesses where the locking means engage the windows in the locked closed position, or the other devices of the prior art, which use angular members that pivot to engage a corner of each movable window, are essentially of a more complicated construction requiring more complicated actuating mechanism than desired for a lock of the type desired.

In the prior patent art, U.S. Pat. No. 1,404,297 to Hunter shows pins 12 and 13 that engage sockets 17 and 18 to lock windows shut. Drilling sockets weakens the windows so that if the windows are not in the exact positions needed for locking by engaging the pins into the sockets, glass windows are liable to chip at the vicinity of each socket.

U.S. Pat. No. 1,766,910 to Knapp discloses a lock having aligned notches 17 at the inner ends of the windows to receive pins 20 to lock the windows. Unless the notches are exactly aligned when the windows close, it becomes difficult for misaligned notches to receive said pins. Therefore, it is difficult to lock the notched windows properly.

U.S. Pat. Nos. 2,196,001 and 2,448,745 to Vanderveld disclose sliding door locks in which pivotally mounted locking members have angular fingers that engage corner portions of the glass windows to be locked into position. Complicated mechanical structures are required to ensure proper alignment of the angular members with the corners of the windows to be locked into position. These locks are relatively expensive to manufacture and require high labor costs to install.

It would be desirable to be able to provide a lock that involves using a simple pin without requiring the need for providing the glass windows or doors with sockets or notches to receive the pins. Unfortunately, when pins have to engage into sockets, it is essential that they be brought into exact alignment with the sockets. Similarly, when angular fingers engage the corners of the windows, it is also necessary that they be properly aligned both as to angle and position with respect to the closed position occupied by the window being locked. The avoidance of complicated structures to ensure proper locking of the glass which is characteristic of the prior art is an important feature of the present invention.

SUMMARY OF THE INVENTION

The present invention provides a lock for a display case having a pair of vertically mounted movable windows that are guided for movement in closely spaced horizontal paths. Each of the windows has an inner vertical edge that overlaps the opposite inner vertical edge of the other window at its inner end when the glass sheets are in their closed locked position. Continuous horizontally extending upper and lower track means are fixed to upper and lower support members to guide the horizontal movement of the windows between open positions where the windows are essentially aligned to provide a window opening and closed window positions wherein the inner vertical edges overlap a minimum possible amount. Each track means comprises a pair of parallel, closely adjacent tracks. One of said track means is provided with a pair of apertures. One of the apertures extends through one track and the other aperture extends through the other track of said one track means in positions adjacent to the positions occupied by the inner vertical edge of one or the other window in the closed window positions to be locked. A pair of locking pins is constructed and arranged to be slidably movable in a vertical direction. One of said pins moves through one of the apertures associated with one of the tracks of the selected track means between a recessed position permitting free movement of one of said windows along one of said tracks and a window locking position along the inner vertical edge of said window that does not penetrate said window to lock one of said windows in its closed window position. A second pin of said pair is slidably movable in a vertical direction through the other of said apertures associated with the other track of said selected track means between a recessed position permitting free movement of the other of said windows along the other track of said track means and a window locking position that does not penetrate said other window to lock the other of said windows in its closed window position by extending said second pin through the other aperture in engagement along the vertical inner edge of the other window.

The rear wall of the showcase is provided with locking means including a movable open wall box member or a movable bar member which locates the first and second pins in fixed relation to one another for simultaneous movement of the locking pins. This fixed relation of the pins to one another is associated with the positions of the apertures extending through the thickness of a base member for horizontal tracks comprising the selected track means. The apertures are located in offset positions where the locking pins can simultaneously engage the inside vertical edges of the glass sheets when the latter are moved into their closed or locked positions to maintain the showcase locked.

The lock means can be supported by support means for either the upper set of track means or the lower set of track means to provide the locking relationship wherever needed. The gist of this invention is the provision of the pins in such locations that they are able to make simultaneous sliding engagement along the inner vertical side edges of both glass windows when the latter occupy their closed or locked positions. In this manner, a simple locking arrangement enables a pair of pins to slide through the apertures in the respective track means to occupy positions of vertical alignment along the vertical inner edges of the windows.

The lock means and pins may be provided in association with the lower or upper track means. In the first case, the locking pins are constructed and arranged to move upwardly in unison to engage the inner vertical side edges of the respective glass sheets along vertical lines extending upward from their lower edges. In the latter case, the pins are moved simultaneously downward through the openings in the upper track means to provide the locking. In one species where the glass windows are supported along their lower edges, a specific embodiment has them reinforced along their lower edges with shoes of H-shape configuration that comprise upper channel members that support the lower glass edges and lower inverted channel members that receive wheels that ride on rails along the bottom end of the openings. In the latter species, the locking pins are lifted simultaneously to lock the windows in the closed position and lowered simultaneously to free the windows for movement along the lower track means through apertures in a base member of the lower track means between the rails on which said wheels ride. This latter species enables the rails to protect the locking pins from a prying tool.

While various types of locking means may be provided, a preferred lock means for display cases of this invention involves an open wall lock box having a closed wall or flat continuous bar facing a track means, closed end walls and an open wall facing away from the track means. A pair of pins are attached to the closed wall of the open wall lock box to extend toward the associated track means. Such lock means is preferred because it may be used either above the upper track means by orienting the pins to extend downward or below the lower track means for the slidable windows by orienting the lock box to have the pins extend upward. The lock means is received in a chamber of sufficient size to provide clearance for moving said box a requisite distance required for moving said locking pins along paths of movement that extend through said apertures.

The chamber may be formed by gouging out a rectangular section large enough to receive the open wall lock box or said flat plate in sliding relation thereto. However, for ease in fabricating, another embodiment forsees using a circular saw to make an elongated domed chamber having parallel longitudinal walls and an arcuate floor or roof gouged out of a track supporting member using a channel member having a pair of side walls that extend between the opposite longitudinal walls of the chamber interconnected by a slotted connecting wall to enclose and guide sliding movement of an open wall lock box. The slot in the slotted connecting wall of the channel member has parallel edge surfaces that slidably engage flat wall portions of a cylindrically shaped barrel housing of the lock to retain said housing in proper orientation as the open wall lock box slides relative to said channel member. In this easily fabricated embodiment, the slotted channel member fits between the parallel longitudinal walls of the elongated chamber and also between the track means and the arcuate floor or roof of said elongated chamber. The slotted connecting wall is fixed to one of the parallel longitudinal walls of the elongated domed chamber to enable the channel member to serve as a box-receiving chamber within which said open wall box is mounted to limit vertical movement of the box within said box-receiving chamber when the barrel of the lock means is rotated within the barrel housing.

A solid metal bar may be used in lieu of the open wall lock box with the pins extending in the proper construction and arrangement towards the adjacent track means from the solid metal bar. A key operated lock serves to move the solid metal bar or open wall box between a position in which the lock pins are extended through the respective track means and a recessed position. If the lock is used to actuate movement of the solid metal bar and its locking pins relative to said lower track means, gravity is depended upon to lower the solid metal bar and its attached locking pins when the key turns to disengage the lock from said bar. If the solid metal bar arrangement is used for raising and lowering pins associated with the upper track means, spring means are suggested to restore the locking pins to an upward recessed position.

BRIEF DESCRIPTION OF THE DRAWINGS

In the drawings which form part of the description of the preferred embodiments of this invention, wherein like reference numbers refer to like structural elements.

DESCRIPTION OF PREFERRED EMBODIMENTS

Figure 1:
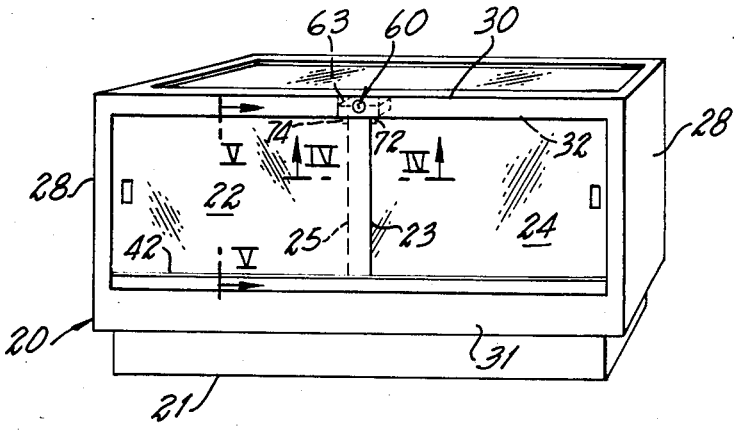
FIG. 1 is a perspective rear view of a showcase provided with locking means conforming to one embodiment of the present invention.
Figure 5:
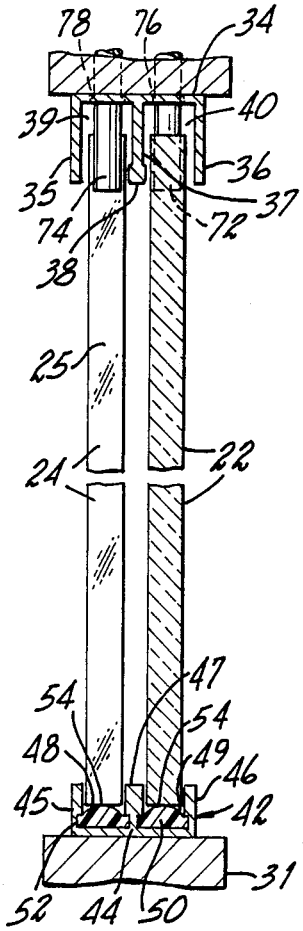
FIG. 5 is a fragmentary vertical sectional view taken along the line V—V of FIG. 1.

Referring to the drawings, FIG. 1 shows a display case 20 mounted on a support 21, and particularly, the rear wall of display case 20 that faces a sales clerk. The rear wall of the display case comprises a window or door 22 having an inner vertical edge 23 and a second window or door 24 having an inner vertical edge 25. Window handles 26 are provided for sliding the doors or windows 22 and 24 relative to one another. The showcase or display case 20 is provided with a pair of vertical side walls 28 that interconnect an upper horizontal support member 30 and a bottom horizontal support member 31. The latter support members cooperate with walls 28 to form a frame. Upper track means 32 fixed to upper support member 30 extends continuously between side walls 28 and comprises a horizontal base member 34 (see FIG. 5), outer downwardly extending vertical flanges 35 and 36 and an intermediate spacer flange 37. The latter is provided with a low friction guide or balancing member of nylon or the like 38, to divide upper track means 32 into a closely spaced parallel pair of upper tracks 39 and 40. Also a lower track means 42 comprising a horizontal base member 44 provided with upwardly extending outer vertical flanges 45 and 46 and an intermediate spacer flange 47 forming a pair of lower tracks 48 and 49 is attached to bottom support member 31 to extend continuously between side walls 28. The inner walls of the outer vertical flanges 45 and 46 are grooved near their bottom and both walls of the intermediate spacer flange 47 are longitudinally grooved likewise. The lower tracks 48 and 49 formed by the horizontal base member 44 and flanges 45, 46 and 47 are provided with nylon guides 50 having feet 52 that extend into the grooves of the grooved flanges and a rounded convex central portion 54 to provide sliding support for the lower edge of the glass windows 22 and 24. This structure enables the doors or windows to move with little frictional resistance in closely spaced parallel vertical planes.

Figure 2:
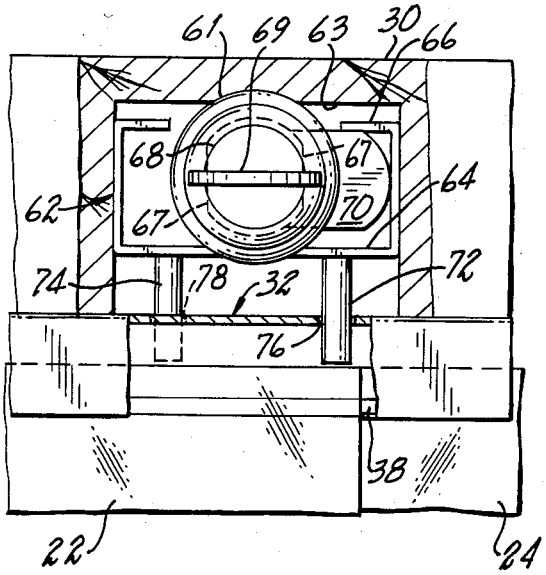
FIG. 2 is an enlarged partial view, partly in section, of a preferred embodiment of locking means, showing the locking pins in recessed position to enable the glass windows of the showcase to move unimpeded.

A lock means 60 is shown supported by the upper support member 30, although a similar lock may be supported by bottom support member 31. Lock 60 comprises a barrel housing 61 supported within an open wall, rigid, lock box 62 received within a chamber 63 cut out of upper support member 30. Lock box 62 is preferably of metal and has a closed wall 64 that faces upper track means 32, closed end walls 65 and an open wall 66 facing away from the track means 32 and extending from the closed walls 65. Barrel housing 61 is externally threaded except for diametrically opposed, smooth flat areas 67. A barrel 68 of lock 60 is actuated by a key 69 and rotates with the barrel 68. The latter extends through open wall 66 and is fixed in position within and across the extent of the open wall box 62 and is provided with a radial arm 70 having a convex outer end that rotates with the key 69 and barrel 68 between a horizontal position engaging one of the portions of open wall 66 and spaced from closed wall 64 to force movement of open wall lock box 62 within chamber 63 in member 30 to a position spaced from the horizontal plane occupied by the upper edges of windows 22 and 24, as seen in FIG. 2. Key 69 also causes the open wall lock box 62 to move downward when it rotates radial arm 70 to the position depicted in FIG. 3 engaging the closed wall 64 that faces track means 32 and spaced from open wall 66. A lock washer 71 (FIG. 3A) has an inner periphery corresponding to the outer periphery of barrel housing 61 and slides axially along barrel housing 61. A locknut 73 is screwed along the threads of housing 61 to force prongs of lock washer 71 to penetrate the inner surface of the rear wall of display case 20 to prevent housing 61 from rotating when key 69 turns barrel lock 68 and radial arm 70.

A pair of locking pins 72 and 74 extend towards track means 32 from the closed wall 64. An opening 76 is provided through horizontal base member 34 along upper track 40 and another opening 78 is provided through base member 34 along upper track 39. These openings are positioned in spaced relation to the side edges of said tracks in alignment with the paths of movement of the locking pins 72 and 74 respectively and are located immediately adjacent the position occupied by the inner vertical edges 23 and 25 of windows 22 and 24 when the latter are in their closed positions, closing entirely the opening for the rear wall of the show case.

Figure 3:
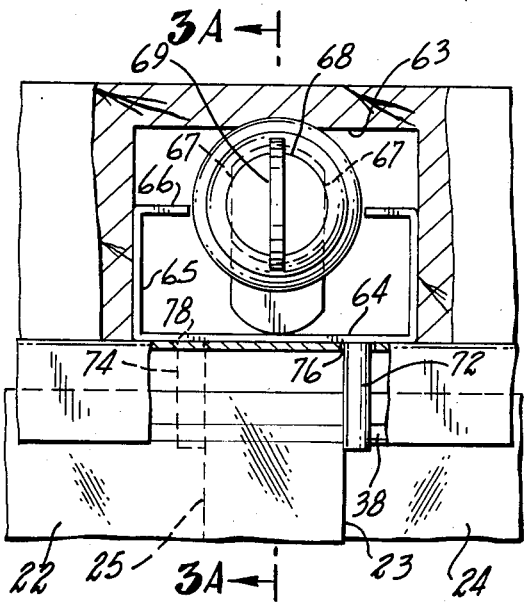
FIG. 3 is a view similar to FIG. 2 showing the locking device in the position it occupies when the locking pins are in their locking position to prevent the doors from moving open.
Figure 4:
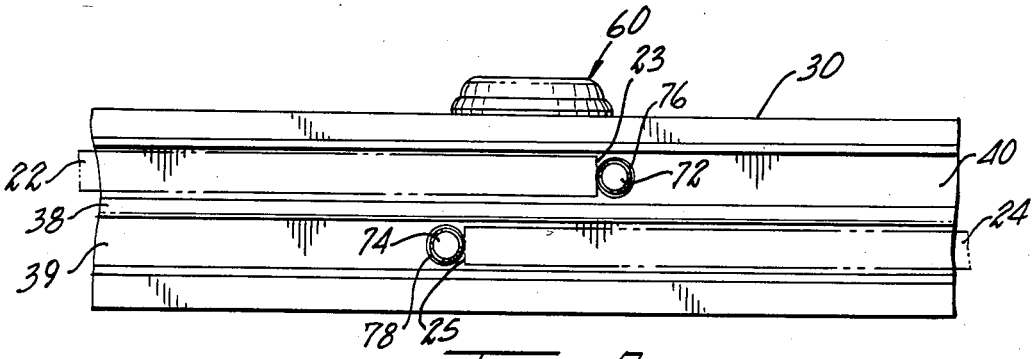
FIG. 4 is a view looking upward along the line IV—IV of FIG. 1.
Figure 3A:
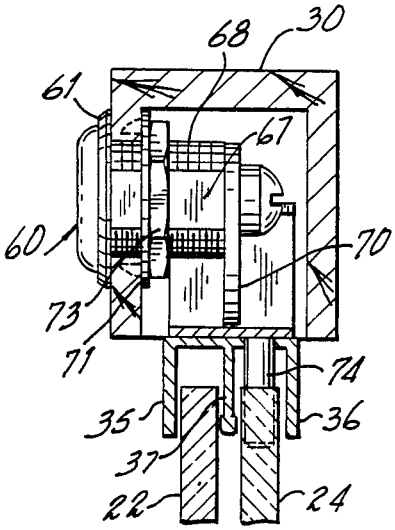
FIG. 3A is an enlarged fragmentary cross-sectional view taken along the line 3A—3A of FIG. 3.

It will be seen that the lock 60 is so arranged that when the key 69 is oriented horizontally as in FIG. 2, radial arm 70 engages open wall 66 and disengages closed wall 64 to raise open wall box 62 and lift locking pins 72 and 74 so that the latter are recessed from the upper edges of the doors or windows 22 and 24 to permit the windows to move horizontally wherever desired along the track means 32 including when the doors 22 and 24 are in their closed positions with their vertical edges 23 and 25 overlapping. As shown in FIG. 3, rotating the key 69 to its vertical orientation causes radial arm 70 to disengage open wall 66 and engage closed wall 64 to force the open wall lock box 62 to move downward to slide the locking pins 72 and 74 through openings 76 and 78 and along the edges of the vertical edges 23 and 25 of the doors to secure them in position.

As an alternative, lock means 60 of FIGS. 1 to 5 may be located within a recess provided in bottom horizontal support member 31 below lower track means 42 and should have box 62 oriented in upside-down relation to that of the first embodiment to lock windows 22 and 24 along the lower portions of their inner edges 23 and 25. In this case, chamber 63 is hollowed out from bottom support member 31 instead of upper support member 30 and openings 76 and 78 are provided through base member 44 of lower tracks 48 and 49 including nylon guides 50 of lower track means 42 to receive locking pins 72 and 74.

Figure 7:
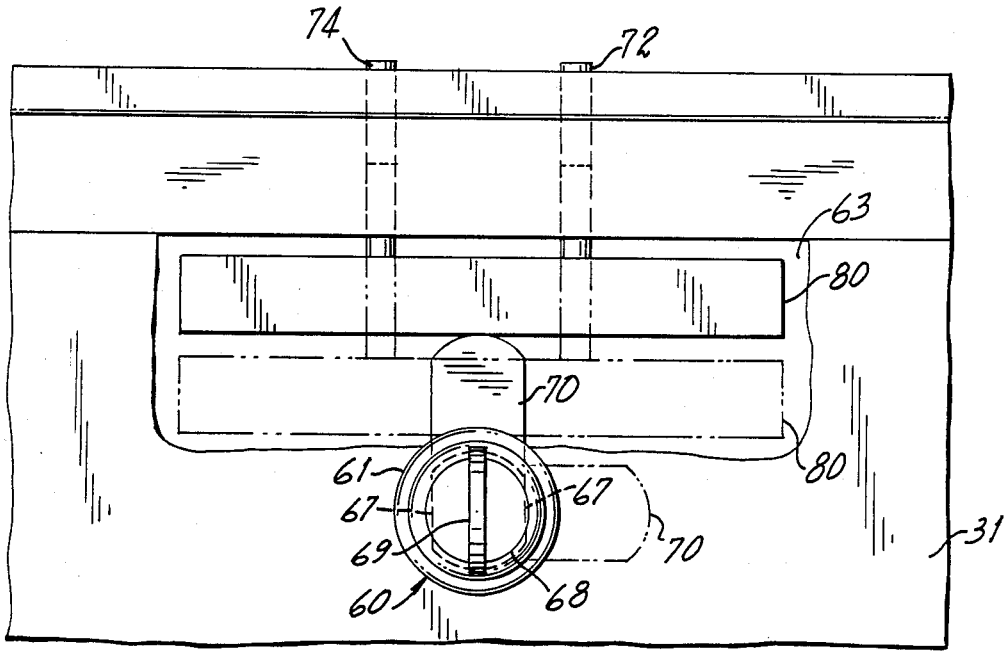
FIG. 7 is an enlarged view partially in section of an alternate embodiment of a locking device provided with a solid metal bar instead of the open wall lock box of FIG. 6 used essentially with a lower track means showing the lock in locking position in solid lines and in unlocked position in phantom.
Figure 8:
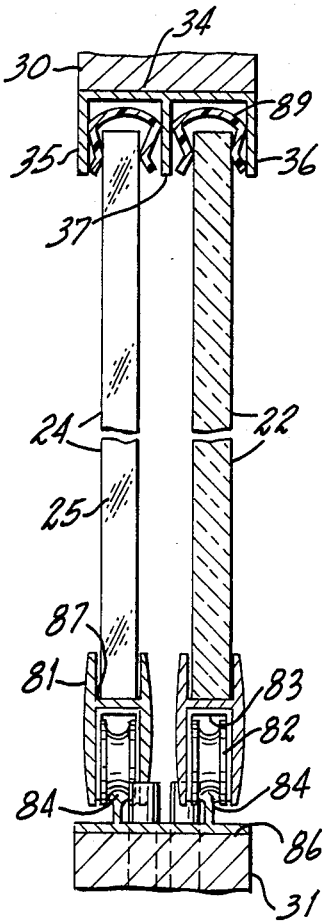
FIG. 8 is a view similar to FIG. 5 of an alternate embodiment of this invention in which glass sheets are engaged along their bottom edges by shoes which are provided with wheels that ride on rails included in the lower track means of this invention.

Referring to FIG. 7, an alternate embodiment is shown that is especially adapted for use with the lower track means 42. In this embodiment, chamber 63 is provided in bottom support member 31 to enable vertical movement therewithin of a solid metal bar 80 from which locking pins 72 and 74 extend upward. Radial arm 70 engages and lifts the bottom surface of bar 80 to lift the latter when key 69 is vertical and allows bar 80 to lower by gravity when key 69 is horizontal to move pins 72 and 74 relative to openings 76 and 78. As seen in FIG. 8, in providing locking means supported by bottom support member 31, it is suitable to use windows or doors that are engaged by H-shaped shoes 81 coextensive in length with the bottom edges of doors 22 and 24. The shoes 81 carry wheels 82 in lower channels 83 of inverted U-shape. The wheels ride on a pair of parallel rails 84 which form parallel lower tracks extending upward from a horizontal base 86. Each shoe 81 contains an upper U-shape channel 87 which encloses and engages the bottom edge of one or the other glass sheet 22 and 24. Thus, in this embodiment, actuation of lock 60 provides movement of the locking pins 72 and 74 relative to openings 76 and 78 through the thickness of the horizontal base 86 for the parallel lower tracks 84 to enable the locking pins 72 and 74 to move between upward extending positions to engage the inner vertical edges 23 and 25 near the bottom edges of the windows 22 and 24 and lowered recessed positions to permit free movement of the windows and their shoes along rails 84. It is noted that FIG. 8 shows that the locking pins 72 and 74 also engage the inner end portions of the shoes that are in vertical alignment with the inner vertical edges 23 and 25 of windows 22 and 24. It is noted also that the apertures 76 and 78 are located inward of and between the rails 84 so as to enable rails 84 to provide protection against anyone tampering with the position of the locking pins 72 and 74. Thus, the metal shoes 81 and rails 84 protect against attempts to pry open the lock by frustrating access to the locking pins 72 and 74 in this embodiment.

Figure 9:
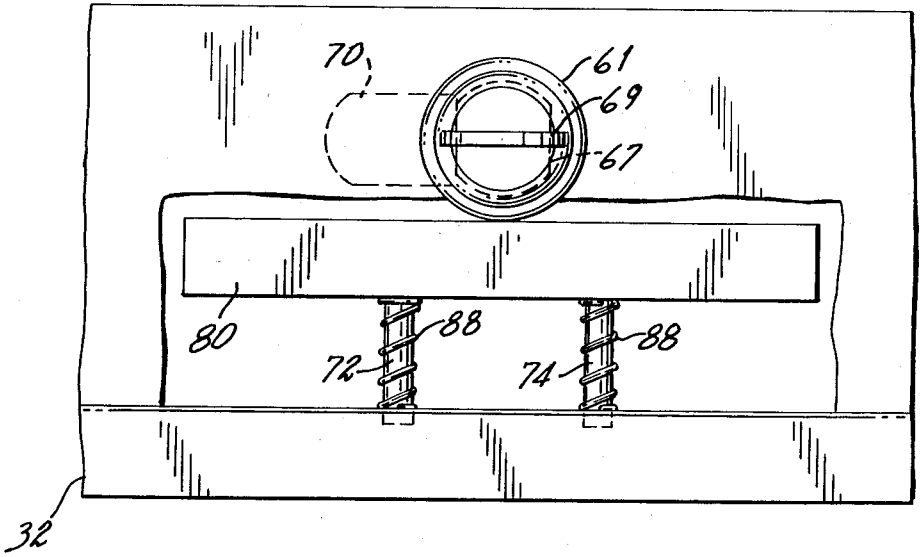
FIG. 9 is a view of the embodiment of FIG. 7 showing it in an arrangement that comprises spring means for actuating locking pins associated with upper track means to move upward to their recessed positions when the lock means disengages from said metal bar.
Figure 6:
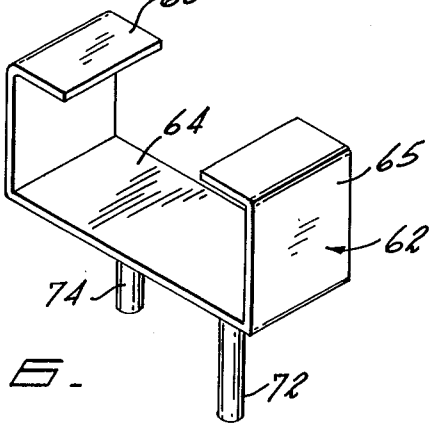
FIG. 6 is a perspective view of an open wall lock box that provides an essential element for the FIG. 1 embodiment of this invention.
Figure 10:
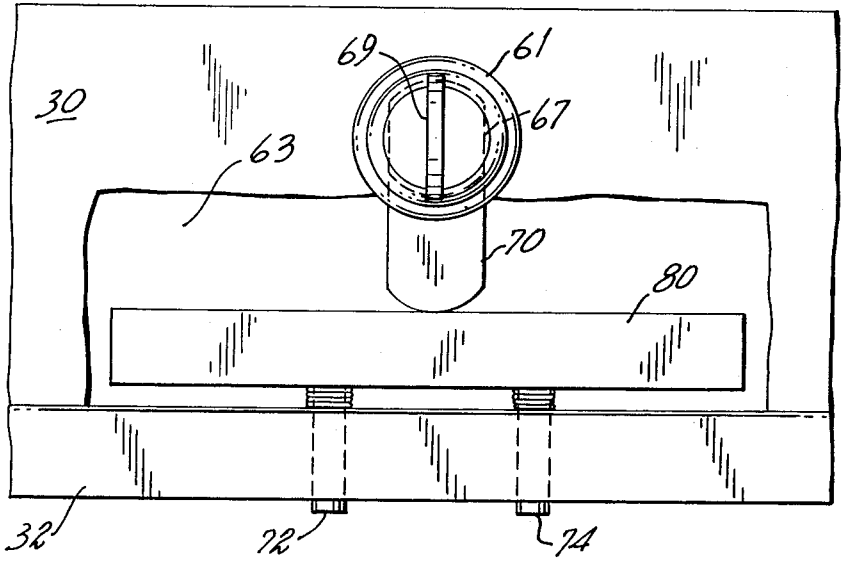
FIG. 10 is a fragmentary view of the FIG. 9 embodiment in its locking position.

In FIGS. 9 and 10, a lock member comprising a solid member bar 80 with downwardly extending locking pins 72 and 74 is shown provided with spring means 88 which include one or more springs that bias solid metal bar 80 upwardly relative to the upper horizontal support member 30. Spring means 88 is constructed and arranged to actuate movement of solid metal bar 80 toward upper horizontal support member 30 so as to lift locking pins 72 and 74 from their positions of engagement of upper track means 32 when radial arm 70 is moved away from the upper surface of bar 80.

While the embodiment of FIGS. 1 to 5 shows locking pins associated with the upper horizontal support member 30 and FIGS. 7 and 8 show the correlation of the lock means of this invention with the bottom support member 31, it is understood that in the usual arrangement of display cases, when display cases are mounted one above the other, the lower display case has the arrangement as depicted in the embodiments of FIGS. 1 to 5 and the upper case has the locking device arranged as depicted in the showing of FIGS. 7 and 8. This arrangement facilitates access of an employee to the locking means of a pair of showcases mounted in vertically stacked relation.

Referring again to FIG. 8, nylon guides 89 are shown coextensive with the upper edge of the doors or windows to reduce friction that interferes with movement of windows 22 and 24 longitudinally within the upper tracks 39 and 40 while the windows are supported for movement within the shoes 81 along their lower edges for movement along parallel tracks 84 in the form of rails. It is understood that the guides 38 or 89 may be employed interchangeably with either the embodiment depicted in FIG. 5 or FIG. 8.

The present invention involves providing a chamber 63 of sufficient size to provide for movement of either the open wall lock box 62 or the solid metal bar 80 which support the pins 72 and 74 for movement relative to either the upper track means or the lower track means, respectively. Locating openings in horizontal base members 34 and/or 44 in vertical alignment with locking pins 72 and 74 in close adjacency to the positions occupied by inner vertical edges 23 and 25 of windows 22 and 24 in their closed positions enables the windows to have their outer edges enclosed within vertical side frame members 28, yet still permit locking pins 72 and 74 to abut inner vertical edges without requiring the windows to be notched to receive said pins, and also provides simple linear pin movements rather than arcuate movements needed for angular corner members to engage the window corners.

In the previous embodiments, chamber 63 is shown having six rectangular sides and an aperture through one of said sides that is also the rear wall of display case 20 to receive barrel housing 61 so that lock means 60 is supported within chamber 63. The latter is shown as of just sufficient size to receive open wall lock box 62 or bar 80 and permit the latter to move the limited distance required for locking pins 72 and 74 to move between their window locking positions and recessed positions permitting free movement of the windows or doors 22 and 24 along track means 32 and 42. Making chamber 63 of such a shape by cutting is an onerous task. A more suitable structure that eliminates a tedious task of cutting and gouging chamber 63 to the desired shape is shown in FIGS. 11 to 13.

The more easily fabricated structure comprises an elongated domed chamber 163 formed by applying a wide circular saw with a dado head to produce a domed elongated chamber 163 having front and rear parallel longitudinal walls 164 and 165 within the thickness of upper horizontal support member 30. At the deepest part of the elongated domed chamber 163, a slotted rigid channel member 170 preferably of metal, is inserted. The latter has a pair of side walls 172 that slidably fit between longitudinal walls 164 and 165 and a slotted connecting wall 174 that slides against rear longitudinal wall 165 which forms the rear wooden wall of display case 20 in the portion of wall 165 that is apertured to receive barrel housing 61 of lock means 60.

Slotted channel member 170 has the minimum dimensions acceptable for chamber 63 so that it slidably encloses open wall lock box 62. Its slotted connecting wall 174 has an open ended slotted portion 176 with straight line margins 178 forming a sliding fit against flat areas 67 of barrel housing 61 and a round end 180 constructed and arranged to surround the outer rounded wall portion of barrel housing 61. A lock nut washer 182 also engages barrel housing 61 and is internally threaded to mesh with the threaded outer wall of barrel housing 61 and is rotated to engage slotted connecting wall 174 against the inner major surface of rear longitudinal side wall 165. In this manner, slotted channel member 170 serves as an alternate embodiment of chamber 63 within elongated domed chamber 163 and also avoids the need for the lock washer 71 of the other embodiments that prevented easy removal of the barrel housing 61.

Figure 11:
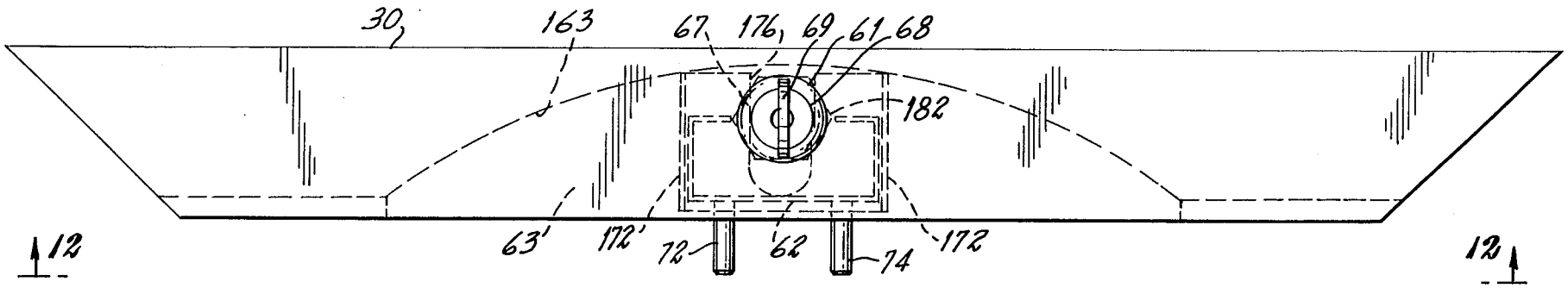
FIG. 11 is an enlarged longitudinal view of a portion of a rear wall of a display case showing an alternate construction for a chamber that encloses said locking means.
Figure 12:
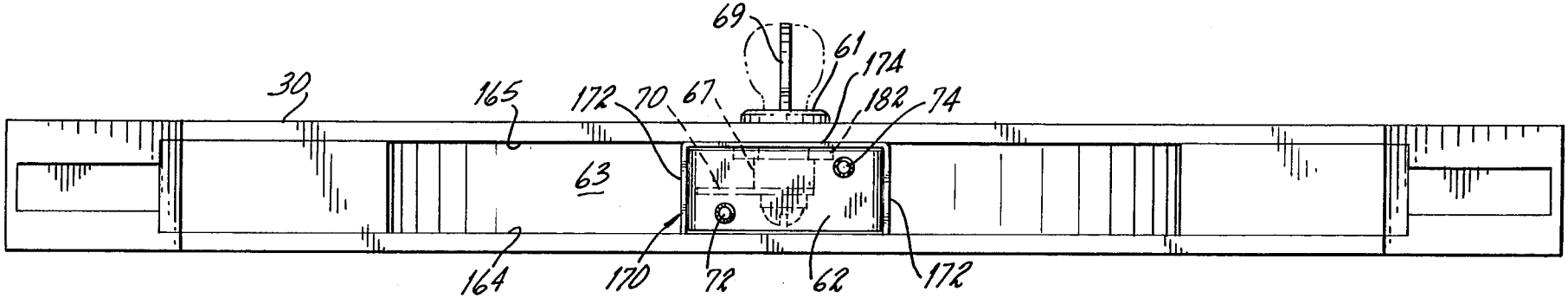
FIG. 12 is a plan view along the line 12—12 of FIG. 11.
Figure 13:
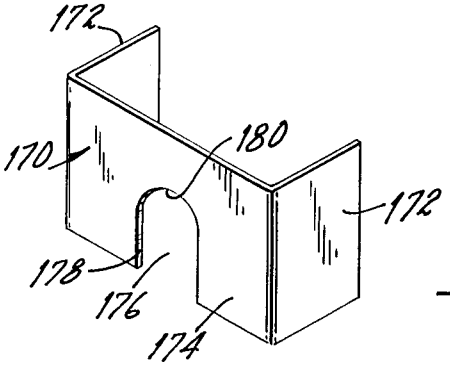
FIG. 13 is an isometric view of the chamber structure of FIGS. 11 and 12.

The present invention provides a method of installing a lock in a frame-like rear wall of a display case conforming to the embodiment of FIGS. 11 to 13 comprising cutting an elongated domed chamber from an edge surface of a support member of said rear wall so that the elongated walls of said chamber are parallel and within the thickness of said support member, aperturing the rear side of said rear wall to receive a barrel housing of said lock there through so that said barrel housing extends into said elongated, domed chamber, inserting a barrel housing with a rotatable barrel therein having a radial arm rotatable with said barrel, said barrel being externally threaded and provided with diametrically opposed flat areas and having a lock washer threaded thereon, orienting said barrel so that said flat areas lie in vertical planes, inserting a slotted channel member having an open end slotted portion in a slotted connecting wall connecting a pair of end walls in such a manner that said slotted portion has straight line margins that slide and abut said opposed flat areas when said barrel housing is properly oriented, continuing to insert said slotted channel member until a round inner end of said slotted portion surrounds said barrel housing after said straight line margins of said slotted portion have slidably engaged said flat areas, rotating said lock washer to secure said slotted connecting wall against one of the elongated walls of said elongated chamber and inserting an open box having an open wall, a pair of end walls extending normal to said open wall and a closed wall parallel to said open wall with a pair of pins fixed to said closed wall and extending away from said open wall within said inserted channel member while said open box is oriented with its open wall facing inward of said elongated chamber and said barrel is rotated to enable said radial arm to extend through the opening in said open wall.

In accordance with the provisions of the patent statutes, the principle, preferred construction and mode of operation of this invention has been explained and what is presently considered its best embodiment and variations thereof have been illustrated and described. However, it should be understood that, within the scope of the claimed subject matter that follows, the invention may be practiced otherwise than as specifically illustrated and described.

What is claimed is:

1. A lock for a display case having a pair of vertically mounted windows movable in closely spaced, parallel, horizontal paths, each of said windows having an inner vertical edge and a length approximately half the length of said display case, horizontally extending track means comprising pairs of parallel tracks defining said paths for guiding said movement of said windows between open positions wherein said windows are essentially aligned to provide an open area approximately half the area of said display case and closed positions wherein said inner vertical edges overlap to cause said windows to close said open area, a pair of apertures extending vertically through said track means in positions longitudinally and transversely spaced along said track means adjacent the positions occupied by the inner edges of said windows and just clear of said windows when the latter occupy said closed positions, said apertures being positioned in spaced relation to the side edges of said respective tracks, a chamber within said display case, a rear wall having an opening communicating with said chamber, an open wall lock box having a horizontally extending vertically movable plate constructed and arranged to be mounted for linear movement in said chamber within said display case, said plate being constructed and arranged to support a pair of vertically extending pins constructed and arranged to be in alignment with said apertures when said plate is installed for operation in said chamber, and lock means supported by said rear wall and extending into said chamber to engage said plate to move said pins through said apertures to slidably engage said inner vertical edges to lock said windows in said closed positions when actuated in one sense and to permit said pins to move to positions clear of said windows when actuated in an opposite sense, whereby said windows are free to move along said track means to said open positions, wherein said plate forms a closed horizontal wall of said open wall lock box having said closed horizontal wall in facing relation to said track means, a pair of end walls extending from the ends of said closed horizontal wall away from said track means and an open wall interconnecting the end walls in spaced relation to said closed horizontal wall, said lock means extending through an opening in said open wall and provided with a radial arm constructed and arranged to engage said open wall in spaced relation to said closed wall to cause said pins to move in said positions clear of said windows and to engage said closed horizontal wall in spaced relation to said open wall to cause said pins to move through said apertures into said inner vertical edge engaging positions.

2. A lock as set forth in claim 1, wherein said track means comprises upper track means supported by an upper support member and lower track means supported by a bottom support member and said plate and said lock means are mounted in said chamber in said upper support member above said upper track means, said apertures are provided along said upper track means and said pins extend downwardly from said plate.

3. A lock as set forth in claim 2, wherein spring means interconnects said plate and said upper support member to bias said plate toward said upper support member when said lock means disengages from said plate.

4. A lock as set forth in claim 1, wherein said track means comprises upper track means and lower track means, an upper support member supports said upper track means and a bottom support member supports said lower track means, said plate and said lock means are mounted in said chamber in said bottom support member, said apertures are provided along said lower track means and said pins extend upwardly from said plate.

5. A lock as set forth in claim 1, wherein said track means comprises upper track means and lower track means, an upper support member supports said upper track means, a bottom support member supports said lower track means, said open wall lock box and said lock means are mounted in said chamber in said upper support member with said closed wall facing said upper track means and said pins extend downwardly from said closed wall.

6. A lock as set forth in claim 1, wherein said track means comprises upper track means and lower track means, an upper support member supports said upper track means, a bottom support member supports said lower track means, said open wall lock box and said lock means are mounted in said chamber in said bottom support member with said closed wall facing said lower track means and said pins extend upwardly from said closed wall.

7. A lock as set forth in claim 2, wherein said track means are composed of metal and guide material is provided along the length of at least one of said track means to protect said windows from direct sliding contact with said metal track means.

8. A lock as set forth in claim 7, wherein said lower track means comprises a horizontal bottom support member, a pair of outer vertical flanges having inner vertical grooved walls and an intermediate spacer flange having grooved walls, nylon guides extending along the length of said lower track means and having transverse feet fitted into said grooved walls and rounded convexly curved central portions between said feet to slidably support the lower edges of said windows.

9. A lock as set forth in claim 2, wherein a shoe of H-shaped configuration extends along the length of the lower edge portion of each of said windows, said lower track means comprises a horizontal track base and a pair of parallel rails extending upward from said base, said shoe having an upper channel member of U-shaped configuration engaging the lower edge portion of one or the other of said windows and a lower channel member of inverted U-shaped configuration, a plurality of wheels rotatably supported by said lower channel member for rotation along one or the other of said parallel rails and said apertures are located through said horizontal track base intermediate said pair of parallel rails.

10. A lock member for use with the lock of claim 1, comprising an open wall lock box adapted to be received within a chamber, said box comprising a first closed wall, a pair of end walls and an open wall constructed and arranged to receive a barrel lock in the opening thereof and a pair of pins spaced from one another transversely and longitudinally of said closed wall and extending outwardly from said closed wall.

11. A lock member as set forth in claim 10, wherein said chamber comprises a slotted channel member within which said box is slidably received, said slotted channel member being constructed and arranged to be supported within an elongated domed chamber having parallel longitudinal side walls within the thickness of said rear wall formed by cutting out a portion of the rear wall of said display case, said slotted channel member having side walls constructed and arranged to extend between said side walls, a slotted connecting wall interconnecting said side walls and having an open-ended slotted portion with straight line margins constructed and arranged to abut flat areas of a barrel housing for a barrel lock supported by said rear wall and extending into said chamber, said slotted portion having a round end portion constructed and arranged to surround said barrel housing between said flat areas, a lock nut washer constructed and arranged to threadedly engage said barrel housing to secure said slotted connected wall against one of said longitudinal side walls to enable said slotted channel member to serve as a box enclosing chamber within which said open wall box is free to slide a limited linear distance in response to rotation of a barrel within said barrel housing.

12. A lock as set forth in claim 1, wherein said chamber within said display case comprises an elongated chamber having a domed inner wall interconnecting front and rear longitudinal side walls, a slotted channel member having dimensions making a sliding fit with said open wall lock box, said lock means comprising a barrel rotatable within an externally threaded barrel housing having opposite, smoothly surfaced flat areas, said slotted channel member having side walls making a sliding fit between said longitudinal side walls, a slotted connecting wall interconnecting said side walls and having an open-ended slotted portion with straight line margins constructed and arranged to abut said flat areas and a round end portion surrounding the outer externally threaded surface of said barrel housing, a lock nut washer threadedly engaging said barrel housing to store said slotted connecting wall against said rear longitudinal side wall to enable said slotted channel member to serve as a box enclosing chamber within which said open wall lock box is free to slide a limited linear distance in response to rotation of said barrel.

13. A method of installing a lock in a frame-like rear wall of a display case comprising cutting an elongated domed chamber from an edge surface of a support member of said rear wall so that the elongated walls of said chamber are parallel and within the thickness of said support member, aperturing the rear side of said rear wall to receive a barrel housing of said lock therethrough so that said barrel housing extends into said elongated, domed chamber, inserting a barrel housing with a rotatable barrel therein having a radial arm rotatable with said barrel, said barrel being externally threaded and provided with diametrically opposed flat areas and having a lock washer threaded thereon, orienting said barrel so that said flat areas lie in vertical planes, inserting a slotted channel member having an open-end slotted portion in a slotted connecting wall connecting a pair of end walls in such a manner that said slotted portion has straight line margins that slide and abut said opposed flat areas when said barrel housing is properly oriented, continuing to insert said slotted channel member until a round inner end of said slotted portion surrounds said barrel housing after said straight line margins of said slotted portion have slidably engaged said flat areas, rotating said lock washer to secure said slotted connecting wall against one of the elongated walls of said elongated chamber and inserting an open box having an open wall, a pair of end walls extending normal to said open wall and a closed wall parallel to said open wall with a pair of pins fixed to said closed wall and extending away from said open wall within said inserted channel member while said open box is oriented with its open wall facing inward of said elongated chamber and said barrel is rotated to enable said radial arm to extend through the opening in said open wall.

14. A method as in claim 13, followed by securing track means to said support member in position to bridge the opening formed by said elongated chamber, thereby maintaining said open box within said slotted channel member.

15. A method as in claim 14, further including rotating said barrel to rotate said radial arm into engagement with said open wall before securing said track means to said support member.

16. A method as in claim 14, wherein said track means have apertures spaced from its side edges, further including aligning said apertures with said pins before securing said track means to said support member.

* * * * *